US005305993A

United States Patent [19]

Staeb

[11] Patent Number: 5,305,993

[45] Date of Patent: Apr. 26, 1994

[54] FOLDER AND STITCHER ASSEMBLY WITH FIRST AND SECOND STITCHING CYLINDERS

[75] Inventor: Rudolf Staeb, Frankenthal, Fed. Rep. of Germany

[73] Assignee: Albert-Frankenthal Aktiengesellschaft, Wurzburg, Fed. Rep. of Germany

[21] Appl. No.: 888,647

[22] Filed: May 27, 1992

[30] Foreign Application Priority Data

May 27, 1991 [DE] Fed. Rep. of Germany ..... 4117205

[51] Int. Cl.[5] ..... B41F 13/64; B42B 2/00

[52] U.S. Cl. ..... 270/37

[58] Field of Search ..... 270/32, 37, 38, 47, 270/52.5, 53, 4, 10, 19, 20.1

[56] References Cited

U.S. PATENT DOCUMENTS

| | | | |
|---|---|---|---|
| 1,177,525 | 3/1916 | Kast | 270/37 |
| 1,343,231 | 6/1920 | Sheldon | 270/53 |
| 2,137,978 | 11/1938 | Mills et al. | 270/37 |
| 4,381,106 | 4/1983 | Loebach | 270/60 |
| 5,000,433 | 3/1991 | Prüm et al. | 270/49 |
| 5,140,380 | 8/1992 | Nokamura et al. | 270/58 |

FOREIGN PATENT DOCUMENTS

| | | | |
|---|---|---|---|
| 0205144 | 6/1986 | European Pat. Off. . | |
| 0355595 | 8/1989 | European Pat. Off. . | |
| 2029864 | 12/1971 | Fed. Rep. of Germany | 270/53 |
| 2822136 | 5/1978 | Fed. Rep. of Germany . | |
| 3628411 | 8/1986 | Fed. Rep. of Germany . | |
| 3534157 | 4/1987 | Fed. Rep. of Germany . | |
| 3828372 | 8/1988 | Fed. Rep. of Germany . | |
| 4041613 | 12/1990 | Fed. Rep. of Germany . | |

*Primary Examiner*—Edward K. Look
*Assistant Examiner*—John Ryznic
*Attorney, Agent, or Firm*—Jones, Tullar & Cooper

[57] ABSTRACT

A folder assembly for a sheet fed printing machine utilizes a collect cylinder that is capable of operating in collect or non-collect modes. A first cross-stitching cylinder and a second cross-stitching cylinder are placed adjacent the collect cylinder. A transfer and jaw cylinder receives cross-stitched signatures and forwards them to a delivery unit.

4 Claims, 9 Drawing Sheets

FOLDER AND STITCHER ASSEMBLY WITH FIRST AND SECOND STITCHING CYLINDERS

FIELD OF THE INVENTION

The present invention is directed generally to a folder assembly for a printing unit. More particularly, the present invention is directed to an adjustable folder assembly having a collect cylinder and associated cross-stitching cylinders. Most specifically, the present invention is directed to an adjustable folder assembly having a collect cylinder and two associated cross stitching cylinders. The collect cylinder of the folder assembly is able to be set for collect and non-collect runs and is provided with holding elements and tucking blades. The cross-stitching cylinders are associated with the collect cylinder in such a way that the signatures collected on the collect cylinder can be cross stitched or stapled in a variety of arrangements of collected signatures. A transfer and jaw cylinder cooperates with the collect cylinder and delivers the cross stitched signatures to a delivery unit.

DESCRIPTION OF THE PRIOR ART

It is generally known in the art to produce printed signatures by using a collect cylinder onto which individual printed sections are delivered from one or more printing cylinders. The collect cylinder can be operated in a collect or non-collect manner. The signatures received by the collect cylinder are then typically folded and can then be cross stitched or stapled to form booklets which may then be further assembled and arranged.

The prior art shows generally a stitching or stapling assembly in which there is provided a continuous supply of stitching wire. A device of this type may be seen in German published unexamined patent application No. 28 22 136.

In the German published unexamined patent application No. 36 28 411 there may be seen a folder with a stitching device in which the stitching device is arranged before the folding cylinder. A similar assembly of a folder with a stitching device arranged before the folding cylinder can be seen in European patent application No. 0 205 144.

While the prior art devices show stitching devices with continuous wire supply and folders with stitching devices generally, there is a need for a folding unit which will operate in collect and non-collect modes and in which the several types of collected or not collected sheets can be cross stitched and forwarded to a delivery unit. The folder assembly of the present invention provides such a device and is a significant advance in the art.

SUMMARY OF THE INVENTION

It is an object of the present invention to provide a folder assembly for a printing unit.

Another object of the present invention is to provide an adjustable folder assembly having a collect cylinder and associated cross-stitching cylinders.

A further object of the present invention is to provide a folder assembly having a collect cylinder and two cross-stitching cylinders positioned about the collect cylinder.

Yet another object of the present invention is to provide a folder assembly with which it is possible to stitch continuously produced, subsequent signatures with a different number of collected signatures on each other.

Still a further object of the present invention is to provide a folder assembly having a collect cylinder with left and right cross stitching cylinders and which cooperates with a subsequent transfer and jaw cylinder.

As will be discussed in greater detail in the description of the preferred embodiment which is set forth subsequently, the folder assembly of the present invention utilizes a collect cylinder which receives a printed paper web that has been printed in a printing unit which may have as many as six or eight printing plates or etchings on its periphery. The paper web is cut into sections and these sections are collected on the collect cylinder to form a variety of collected signatures with each signature having a number of sections determined by how the collect cylinder is operating; i.e. whether it is operating in collect or non-collect production. The various collected signatures or sections are then cross stitched or stapled using two cross-stitching cylinders, each of which has at least one field and a first of which may have three fields.

If the print cylinder has six plates or images, the folder assembly of the present invention allows the production of two sections (AB) collected; i.e. double collection plus one section (C) that is non collected. In a structure where the print cylinder has eight plates or etchings, the folder assembly can produce three sections (ABC) collected; i.e. triple collection plus one section (D) that is non-collected. This is accomplished in a device in which the stitching wire supply is continuous.

The folder assembly of the present invention provides a device which overcomes the limitations of the prior art devices and in which there is provided a larger degree of operational flexibility. As such, the present folder assembly is a substantial advance in the art.

BRIEF DESCRIPTION OF THE DRAWINGS

While the novel features of the folder assembly in accordance with the present invention are set forth with particularity in the appended claims, a full and complete understanding of the invention may be had by referring to the detailed description of the preferred embodiment, which is presented subsequently, and as illustrated in the accompanying drawings, in which:

DESCRIPTION OF THE PREFERRED EMBODIMENT

Figure 1:
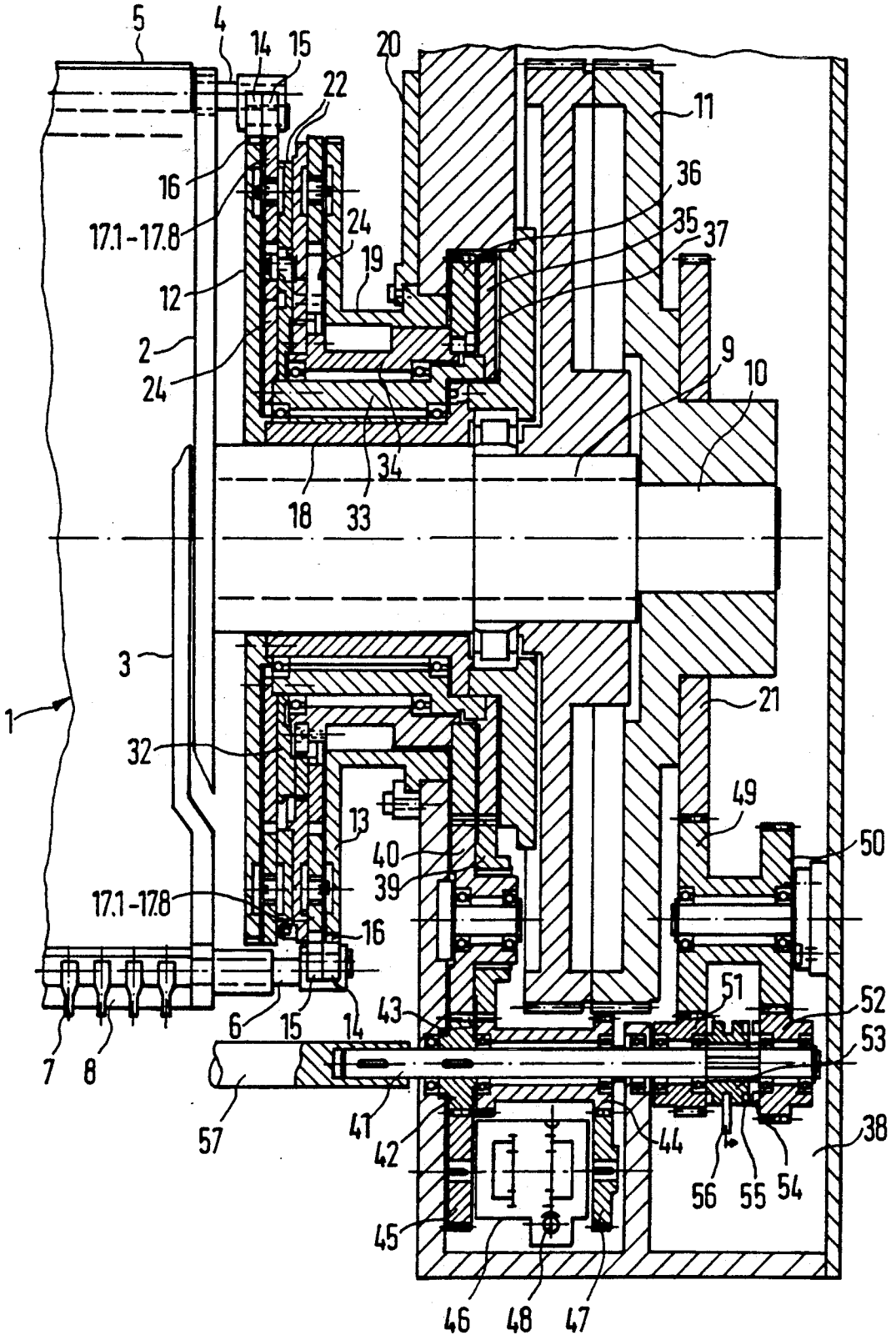
FIG. 1 is a cross-sectional view through the drive and control portion of a collect cylinder of a folder in accordance with the present invention.

Referring initially to FIG. 1, there may be seen generally at 1 a collect cylinder which is usable in the folder assembly of the present invention. The collect cylinder 1 shown in FIG. 1 and further in FIGS. 2–8 is generally the same as the assembly shown in German published unexamined patent application No. 38 28 372, which corresponds to U.S. Pat. No. 5,000,433 issued Mar. 19, 1991; and in German published unexamined patent application No. 4,041,613. Both of these German applications and the above-recited U.S. patent are assigned to the assignee of the present application. Their disclosures are incorporated herein by reference.

The collect cylinder 1 shown in FIG. 1 of the folder assembly consists of two fixture carriers which in cross section are stellate and are able to be evenly driven, the same having the form of a laterally bearinged tucking blade part 2 and of a gripper part 3 bearinged thereon. The tucking blade part 2 is provided with tucking blades 5 able to be operated by an actuating device 4. The gripper part 3 is provided with gripper bars 8 bearing grippers 7 and able to be operated by an actuating device 6. Drive wheels 11 with the same diameter are keyed side by side on the coaxial journals 9 and 10 of the tucking blade part 3 and, respectively, of the gripper part 3. These drive wheels may be coupled together by means of a bridging drive, not shown here, to ensure even drive while at the same time allowing a possibility of adjustment.

In order to perform a folding operation, the tucking blades 5 are moved outwards and the grippers 7 are opened. For this purpose there are cams 12 and, respectively, 13 placed coaxially to the cylinder at the end of the same, which actuate follower means for operation of the associated actuating devices 4 and, respectively, 6. The actuating devices 4 and, respectively, 6 for this purpose each comprise two follower rollers 14 and 15 mounted on a common shaft alongside each other and of which the one follower roller 14 runs on the respectively associated drive cam 12 and, respectively, 13 and the other follower roller 15 runs on a respective covering device, adjacent to one of the cams 12 and, respectively, 13, for laterally covering over the cam recesses 16 on the cam side, such recesses 16 causing operation of the tucking blades 5 and, respectively, the grippers 7. Clear of the cam recess 16 the cams 12 and, respectively, 13 have a circular peripheral form. Dependent on the type of production run the cam recesses 16 are freed during each rotation of the collect cylinder 1 (non-collect run) or during each n-th rotation of the collect cylinder 1 (collect run) and are otherwise laterally covered over. The covering devices are for this purpose provided with covering cam elements 17.1–17.8 arranged in parallelism with the respectively associated cam 12 and, respectively, 13. The breadth of the follower rollers 14 and, respectively, 15 is the same as the breadth of the cams 12 and 13 and, respectively the covering cam elements 17.1–17.8.

The cams 12 and 13 are stationary in relation to the driven collect cylinder The cam 12 provided for operation of the tucking blades 5 is secured to a bushing 18 fixed to the housing and encompassing the outer journal 9. The cam 13 associated with the grippers 7 is secured to a radially outer bushing 19 rotatably mounted in the machine frame. An adjustment bar 20 is secured to the bushing 19 and is used for adjustment of the cam 13 for timing the opening of the grippers. The adjustment bar 20 may be driven by means of an auxiliary drive in the form of an auxiliary motor or the like for adjusting the paper side or it may simply be adjusted by hand. During production, the adjustment bar is locked so that it cannot be twisted. The covering devices having the covering cam elements 17.1–17.8 and associated with the cams 12 and, 13 respectively, are driven during production so as to move in relation to the cams 12 and 13 which are stationary. For this purpose the outer drive wheel 11 has a drive gear ring 21 flanged on it, from which the drive of the two covering devices associated with the two cams 12 and, respectively, 13 is derived.

Figure 2:
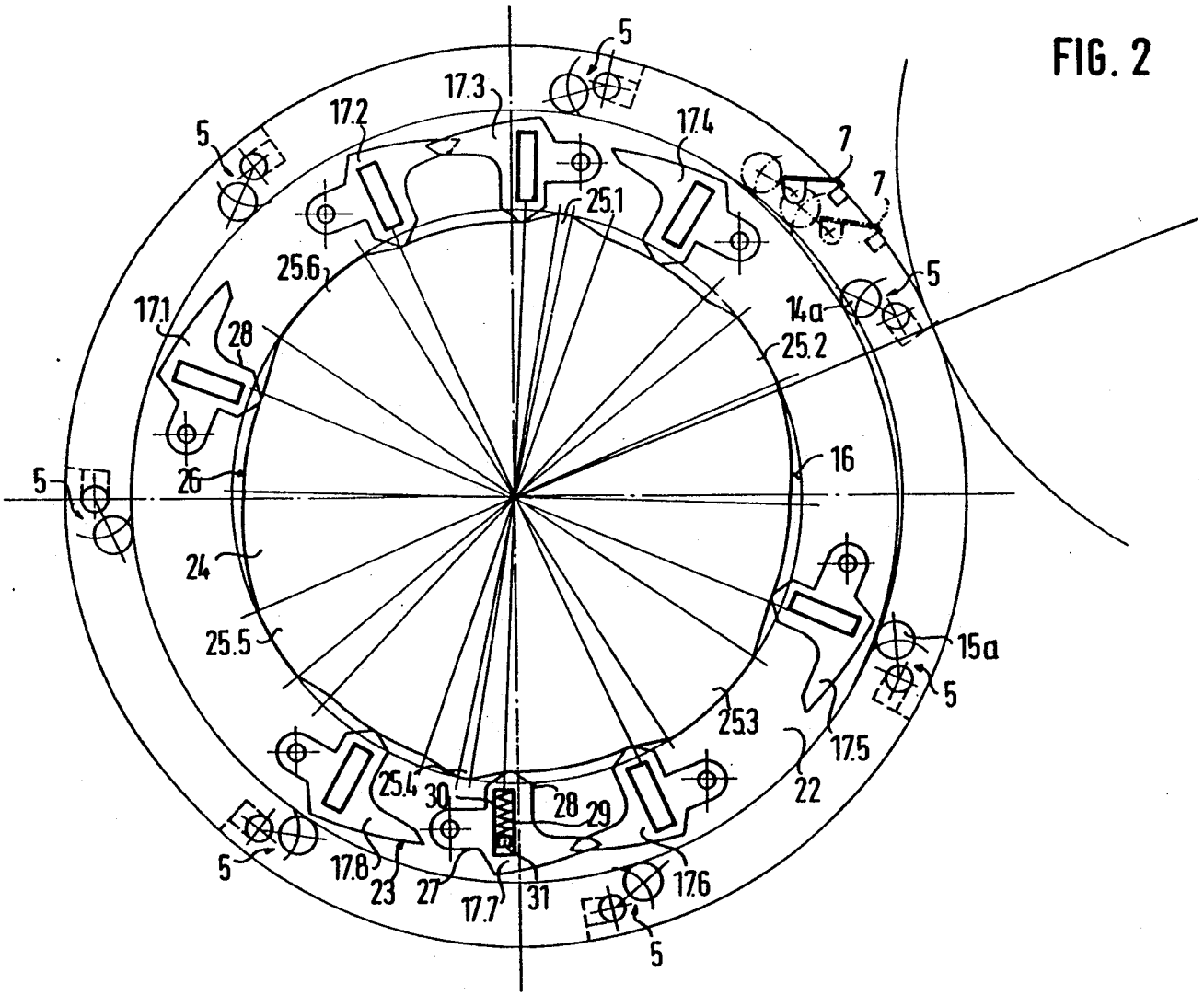
FIGS. 2–7 are end views, with portions removed for clarity, of a collect cylinder having a variable covering disk provided with retractable cam covering element settings for different production types.

As may be diagrammatically seen from FIG. 2 for the covering devices for the cam 12 associated with the tucking blades, the two covering devices each comprise a cam element carrier 22, arranged coaxially to the respective cam and on which the covering cam elements 17.1–17.8 are mounted with a possibility of adjustment in a radial direction. The peripheral form 23 of the covering cam elements 17.1–17.8 represents a part of a circle with a radius conforming to the radius of the circular cam 12 provided outside the cam recess 16 formed by a peripheral recess. The peripheral form 23 of the covering cam elements 17.1–17.8 may be changed between a radially outer active setting aligned with the circular arc contour of the associated cam 12 and a passive position radially within the cam recess by setting the covering cam elements 17.1–17.8. In the active setting, the covering cam elements 17.1–17.8 cover over the recess 16 laterally on moving past it so that the follower roller running on the respective cam 12 or, respectively, 13 is prevented by the adjacent follower roller 15 running over a covering cam element 17.1–17.8 from falling into the cam recess 16 and causing a folding operation when it moves over the cam recess 16. This is indicated at 15*a*. The actuating device associated with the tucking blade 5 just passing through the folding or tucking gap may on the other hand drop into the cam recess 16 and lead to a folding operation, as is in fact indicated at 14*a*. In order to adjust the covering cam elements 17.1–17.8 there is a setting or adjustment disk 24, respectively, arranged coaxially in relation to the cam element carrier 22 and aligned axially with the covering cam elements. The disk 24 is provided with fixed cam elements 25.1–25.6 and peripheral recesses 26 arranged therebetween.

The covering cam elements 17.1–17.8 are respectively attached to a pivoting arm 27 able to pivot about an axis parallel to the axis and mounted on the cam element carrier 22 and have a radially inwardly extending follower 28 which is held by the action of a loading spring 29 in contact with the peripheral surface of the associated setting disk 24. The loading spring 29 is received in a recess 30 of the associated covering cam element 17.1–17.8 and at one end bears on the inner end of the recess 30 on the cam element side and at the other end on a pin 31 which extends into the recess 30 and is attached to the cam element carrier 22.

After adjustment of the disk 24, the cam element carriers 22 bearing the adjustment disk 24 and the covering cam elements 17.1–17.8 are evenly driven during operation, so that during the operation of the folder, the covering cam elements 17.1–17.8 maintain their position as determined by the setting disk 24. The drive speed of the entire covering device formed by the cam element carrier 22 and the setting disk 24 is however selected in a manner dependent on the respective type of production that the covering cam elements 17.1–17.8 which have been outwardly set, move clear of the cam recess 16 in such a manner that only the desired number of folding operations is performed.

Since the tucking blades 5 and the grippers 7 associated therewith operate synchronously, the two cam element carriers 22 and the two setting disks 24 of the respectively associated covering devices may be permanently connected with each other to simplify the necessary drive means. Accordingly, as will be further seen from FIG. 1, the two cams 12 and, respectively, 13 are so spaced apart axially that the covering devices, which are arranged with the mutually abutting cam element carriers 22, have sufficient space therebetween. The cam element carriers 22 placed back to back are firmly clamped together by clamping means. The setting disks 24 placed under the covering cam elements 17.1–17.8 turned towards the respectively associated cam 12 and, respectively, 13, are screwed together with a spacing member 32 between them with a thickness conforming to the overall thickness of the cam element carriers which are clamped together. In order to rotatably support the cam element carriers 22 joined together and, respectively, the covering disks 24, there are two bushings 33 and 34 arranged in the part between the bushings 18 and 19 bearing the cams 12 and 13. The radially inner bushing 33 carries the directly abutting cam element carriers 22 and the radially outer bushing 34 carries the setting disks 24 connected together with the spacing member 32 between them. A respective one of the adjustment or setting disks 24 and one of the cam element carriers 22 is arranged so that its radially inner edge extends in this respect as far as the respectively associated bushing 33 and, respectively, 34 and is screwed to the same. The respectively other setting disk 24 and the respectively other cam element carrier 22 may come to an end further to the outside The spacing member 32 has its spacing jaws extending through the window associated with the same, of the cam element carrier 22 secured to bushing 34. The other cam element carrier 22 comprises the spacing member 32.

The bushings 33 and 34 bearing the setting disks 24 and, respectively, the cam element carriers 22 are rotatably supported and at their ends remote from the cylinder are provided with flange mounted drive gear rings 35 and 36 with the same diameter, which are received in a chamber 37 delimited by the bushings 18 and 29 on the cam side and which is accessible from the gear box 38. The driving gear rings 35 and 36 are in mesh with associated intermediate wheels 39 and 40 of the same diameter, which are rotatably mounted on the frame. The intermediate wheel 40 in the gear train associated with the cam element carriers 22 in this respect meshes with a pinion 42 keyed on an intermediate shaft 41 arranged parallel to the cylinder axis outside the diameter of the collect cylinder. The intermediate wheel 39 belonging to the gear train of the adjustment disks 24 is in mesh with a gear ring 43 of a double wheel, whose two gear rings 43 and 44 have the same diameter as the pinion 42. The pinion 42 is in mesh with the input wheel 45 of a differential drive 46 arranged parallel to the axis and adjacent to the intermediate shaft 41, whose output wheel 47 is in mesh with the second gear ring 44 of the double wheel bearinged on the intermediate shaft 41. The differential drive 46 makes possible an adjustment of the output wheel 47 in relation to the input wheel 45 having the same diameter by means of an auxiliary drive device 48. During normal production, the auxiliary drive device 48 is inactivated so that the differential drive 46 functions as a rigid double wheel. Prior to the start of production, the adjustment disks 24 may be rotationally set as desired by operation of the auxiliary drive device 48.

The intermediate shaft 41 bearinged in the gear box 38 is for its part able to be driven at different speeds by means of the drive gear ring 21 flanged on the outer drive wheel 11. For this purpose there is a double wheel, bearinged on a journal which is secured to the frame and having two gear rings 49 and 50 with different diameters, which for their part are in mesh with drive wheels 51 and 52 also having different diameters and being able to turn freely on the intermediate shaft 41. The drive wheels 51 and 52 are able to be alternatively coupled with the intermediate shaft 41 by means of a coupling dog 53 arranged between them and able to slide on the intermediate shaft 41. The drive wheels 51 and 52 are for this purpose provided with two axially projecting dog teeth 54 on their facing ends and the coupling part 53 having suitable recesses 55 is able to be engaged with these teeth 54 so that there is a defined coupling effect with the desired register. By means of an operating lever 56 fitting into a peripheral groove, the coupling part 53 is able to be moved out of the left engagement position shown in FIG. 1 through a center position in which there is no engagement, into a right engagement position. By suitable operation of the operating lever 56 it is thus possible to bring about two different speeds of operation and, respectively, a stationary state of the covering devices.

In the illustrated working example of the invention with a 7-part collect cylinder the cam element carrier 22 is, as will furthermore be seen from FIG. 2, provided with eight adjustable covering cam elements 17.1–17.8, whose peripheral form 23 subtends an angle of approximately 10°–20°.

The eight covering cam elements 17 are distributed in two groups offset by 180° against each other, each of four covering cam elements 17.1, 17.2, 17.3, 17.4 in the first group, with an angle of 90° between them and 17.5, 17.6, 17.7, 17.8 in the second group. Respectively two covering cam elements 17.1–17.5; 17.2–17.6; 17.3–17.7; and 17.4–17.8 are facing each other diametrically, as is seen in FIG. 2. The setting disk 24 is in this respect provided with six fixed peripheral cam elements 25.1 to 25.6, which are distributed in two groups offset by 180° against each other, with three peripheral cam elements 25.6, 25.1, 25.2; 25.3, 25.4, 25.5 in each group. The distances one to six (angle degree) of the peripheral cam elements 25.1 to 25.6 are:

$\Delta n1$ between peripheral cam element 25.6 and 25.1=56.25°

$\Delta n2$ between peripheral cam element 25.1 and 25.2=48.00°

$\Delta n3$ between peripheral cam element 25.2 and 25.3=75.75°

$\Delta n4$ between peripheral cam element 25.4 and 25.5=56.25°

$\Delta n5$ between peripheral cam element 25.5 and 25.6=48.00°

$\Delta n6$ between peripheral cam element 25.6 and 25.1=75.75°

The peripheral cam elements 25.1 to 25.6 of the setting disk 24 have a different peripheral extent, unlike the covering cam elements 17.1–17.8. The peripheral cam elements 25.1 to 25.6 have the following peripheral extents: (=operating position length) in angle degree:

peripheral cam element 25.1: 1°–2°
peripheral cam element 25.2: 12°–14°
peripheral cam element 25.3: 22°–24°
peripheral cam element 25.4: 1°–2°
peripheral cam element 25.5: 12°–14°
peripheral cam element 25.6: 22°–24°.

The distance of the peripheral cam elements 17.1 to 17.8 is, measured in the circular angle (angle degree):

$\Delta\alpha 1$ between 17.1 and 17.2=45°

$\Delta\alpha 2$ between 17.2 and 17.3=15°

$\Delta\alpha 3$ between 17.3 and 17.4=30°
$\Delta\alpha 4$ between 17.4 and 17.5=90°
$\Delta\alpha 5$ between 17.5 and 17.6=45°
$\Delta\alpha 6$ between 17.6 and 17.7=15°
$\Delta\alpha 7$ between 17.7 and 17.8=30°
$\Delta\alpha 8$ between 17.8 and 17.1=90°.

The distance between two covering cam elements is respectively measured from one half peripheral length to half peripheral length, in which the covering cam elements 17.1 to 17.8 and the peripheral cam element 25.1–25.6 with the peripheral recesses 26, of the setting disk 24, being between the peripheral cam elements 25.1–25.6, make possible together with the different drive speeds of this 7-part collect cylinder to run every desired type of production from non-collect run with alternately using 4e-, 6e- or 8e-form cylinders (A+B; A+B+C; A+B+C+D); double-collect with using 4e- or 8e- form cylinders (AB; AB+CD); threefold-collect with using 6e-form cylinders (ABC); fourfold-collect with using 8e-form cylinders (ABCD); partial-collect with using 6e-form cylinders (AB+C); partial-collect with using 8e-form cylinders (A+BCD). A 6e-from cylinder, for example, means a cylinder with 6 etchings or plates on its periphery.

The positioning of the setting disk 24 depicted in FIG. 2 in relation to the cam element carrier 22 and thus in relation to the covering cam elements 17.1–17.8 is according to the production type non-collect and alternately using 4e-, 6e- or 8e-form cylinders, in which a single-ply product is the result. The setting disk 24 is adjusted so that none of the covering cam elements 17.1–17.8 is projected, which means, every row of tucking blades 5 executes a folding operation, every gripper row 7 opens during the folding operation. As such, every one of the seven tucking blade rows or gripper rows 7 finds, at every rotation of the collect cylinder, one open cam recess 16, and performs a folding operation. The same is also correct for the gripper rows 7. None of the covering cam elements 17.1–17.8 is projected. The driving speed, which means, the number of revolutions of the cam element carriers 22 and the setting disks 24 is $\frac{7}{8}$ of the speed of the collect cylinder, which carries respectively seven tucking blades and gripper rows.

Figure 3:
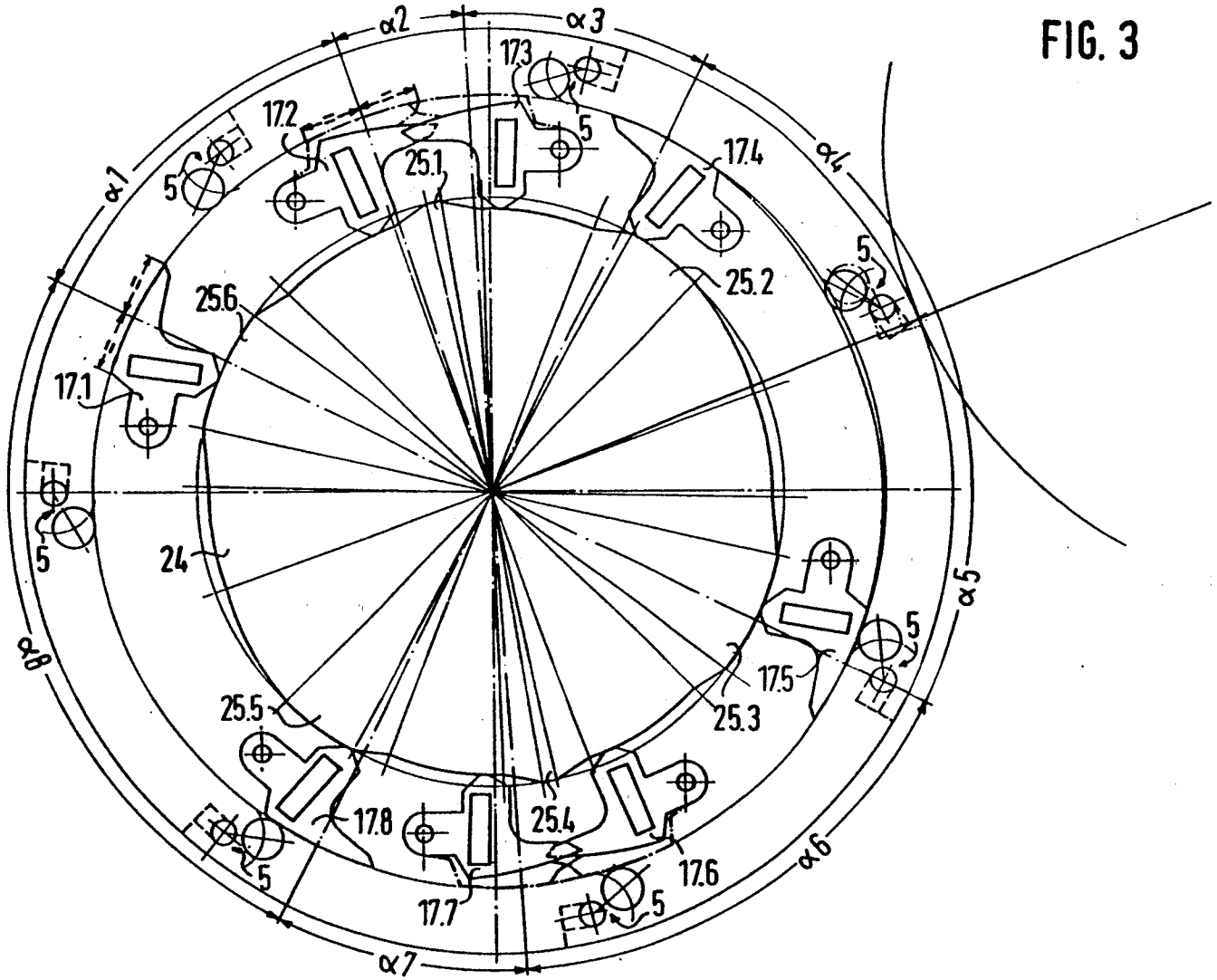

The positioning of the setting disk 24, shown in FIG. 3 is according to the production type double-collect using 4e- or 8e- form cylinders. The result is a two-ply product. The switching cam elements 17.1 and 17.4 or 17.5 and 17.8 are projected, the switching cam elements 17.2 and 17.3 or 17.6 and 17.7 are retracted. The drive speed of the ca element carrier 22 and of the setting disk 24 is $\frac{7}{8}$ of the speed of the collect cylinder 1. At every second rotation of the collect cylinder, the follower roller of every tucking blade row 5 or gripper row 7 finds a free cam recess 16 and performs a folding operation or the gripper row 7 opens.

Figure 4:
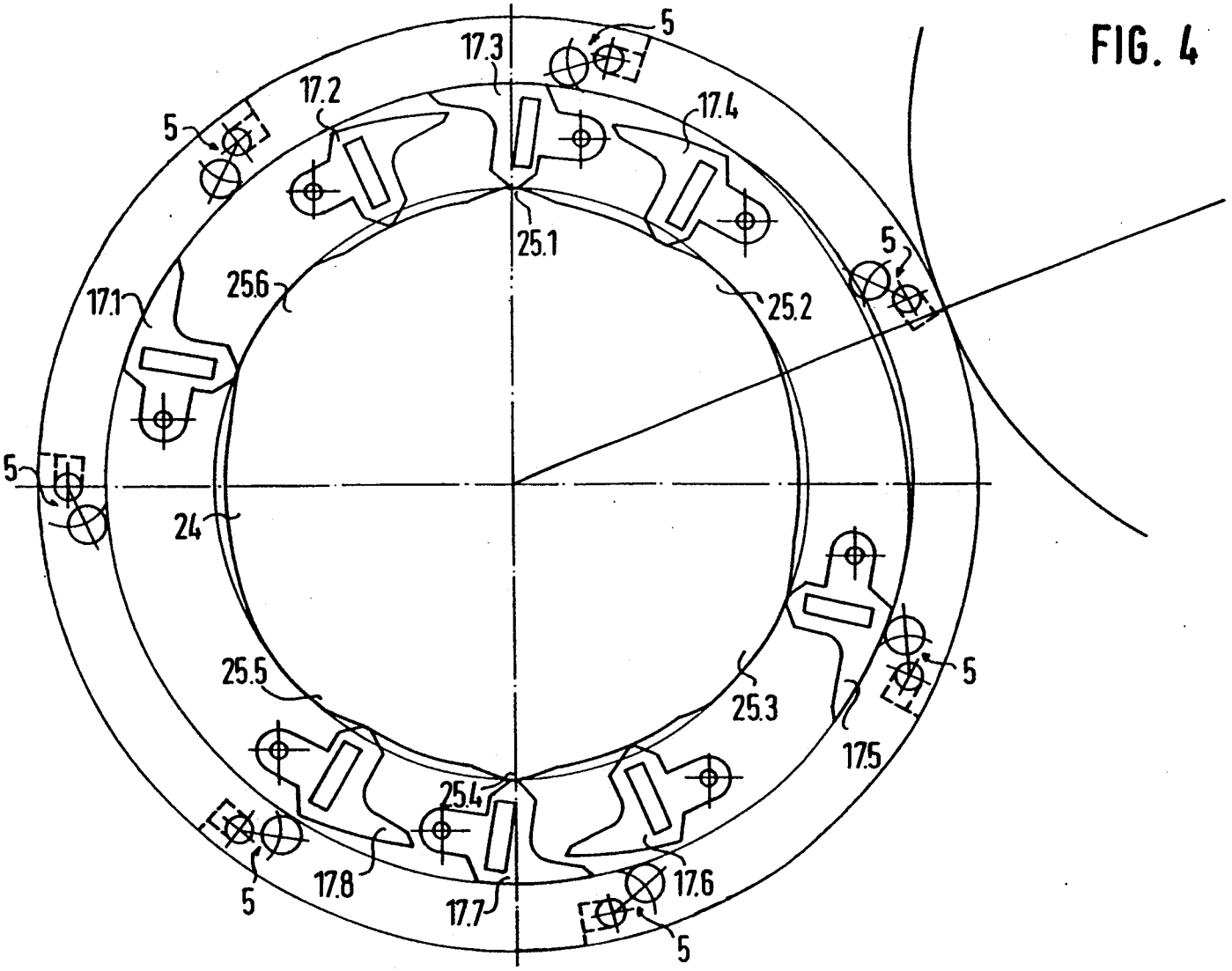

The arrangement of the setting disk 24, as seen in FIG. 4, is according to the production type threefold-collect using 6e-form cylinders. The result is a three-ply product. The first and the third switching cam element 17.1 and 17.3 or 17.5 and 17.7 are projected and switching cam elements 17.2 and 17.4 or 17.6 and 17.8 are retracted. The drive speed of the cam element carrier 22 and of the setting disk 24 is 7/6 of the speed of the collect cylinder 1. At every third rotation of the collect cylinder, the follower roller of every tucking blade row 5 or gripper row 7 finds a free cam recess 16 and performs a folding operation or the gripper row 7 opens.

Figure 5:
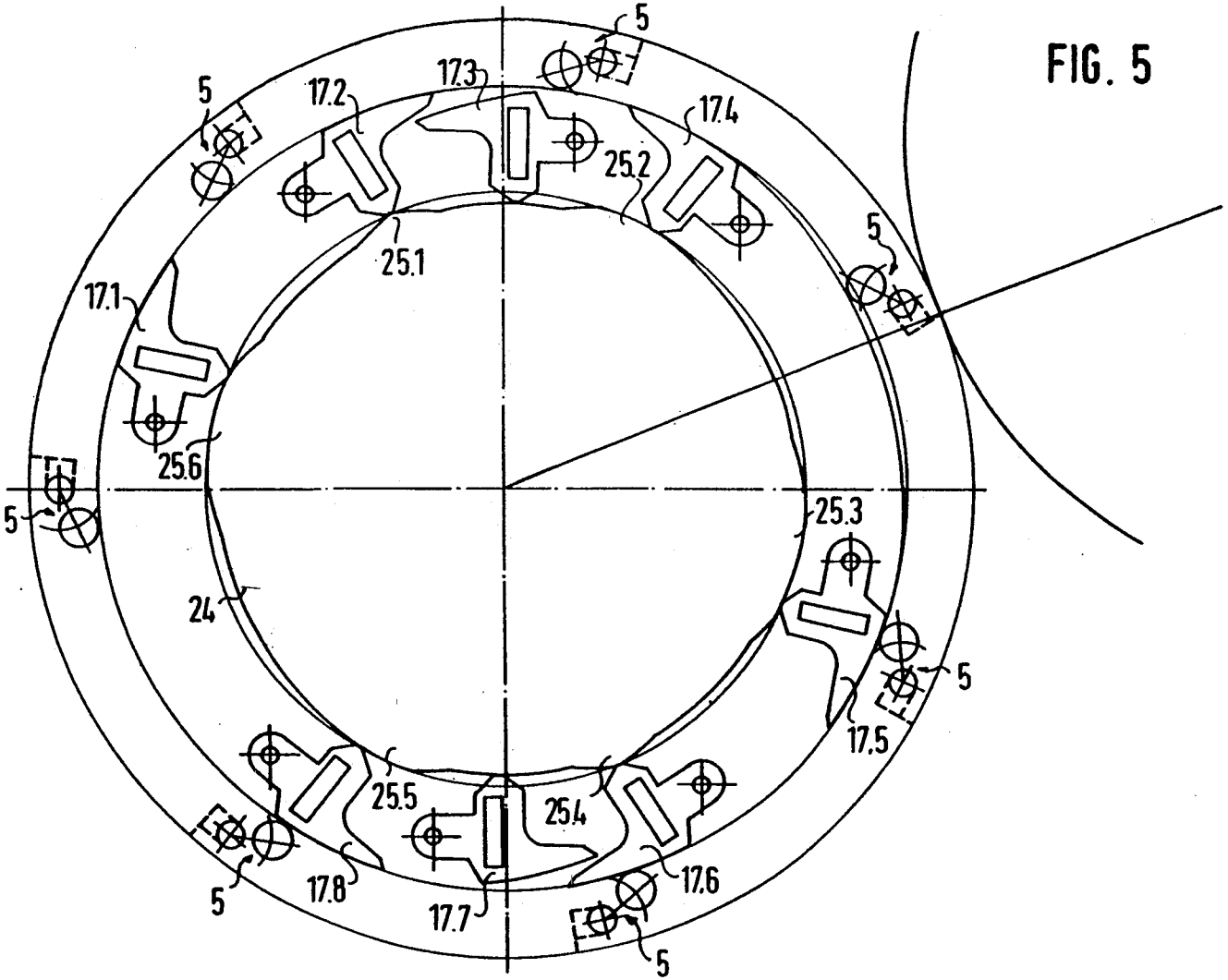

The placement of the setting disk 24, shown in FIG. 5 is according to the production type fourfold-collect using 8e-form cylinders. The result is a four-ply product. The switching cam elements 17.1, 17.2 and 17.4 or 17.5, 17.6 and 17.8 are projected, the switching cam elements 17.3 or 17.7 are retracted. The drive speed of the cam element carriers 22 and of the setting disk 24 is $\frac{7}{8}$ of the speed of the collect cylinder. At every fourth rotation of the collect cylinder the follower roller of every tucking blade row 5 or gripper row 7 finds a free cam recess 16 and performs a folding operation or the gripper row 7 opens.

Figure 6:
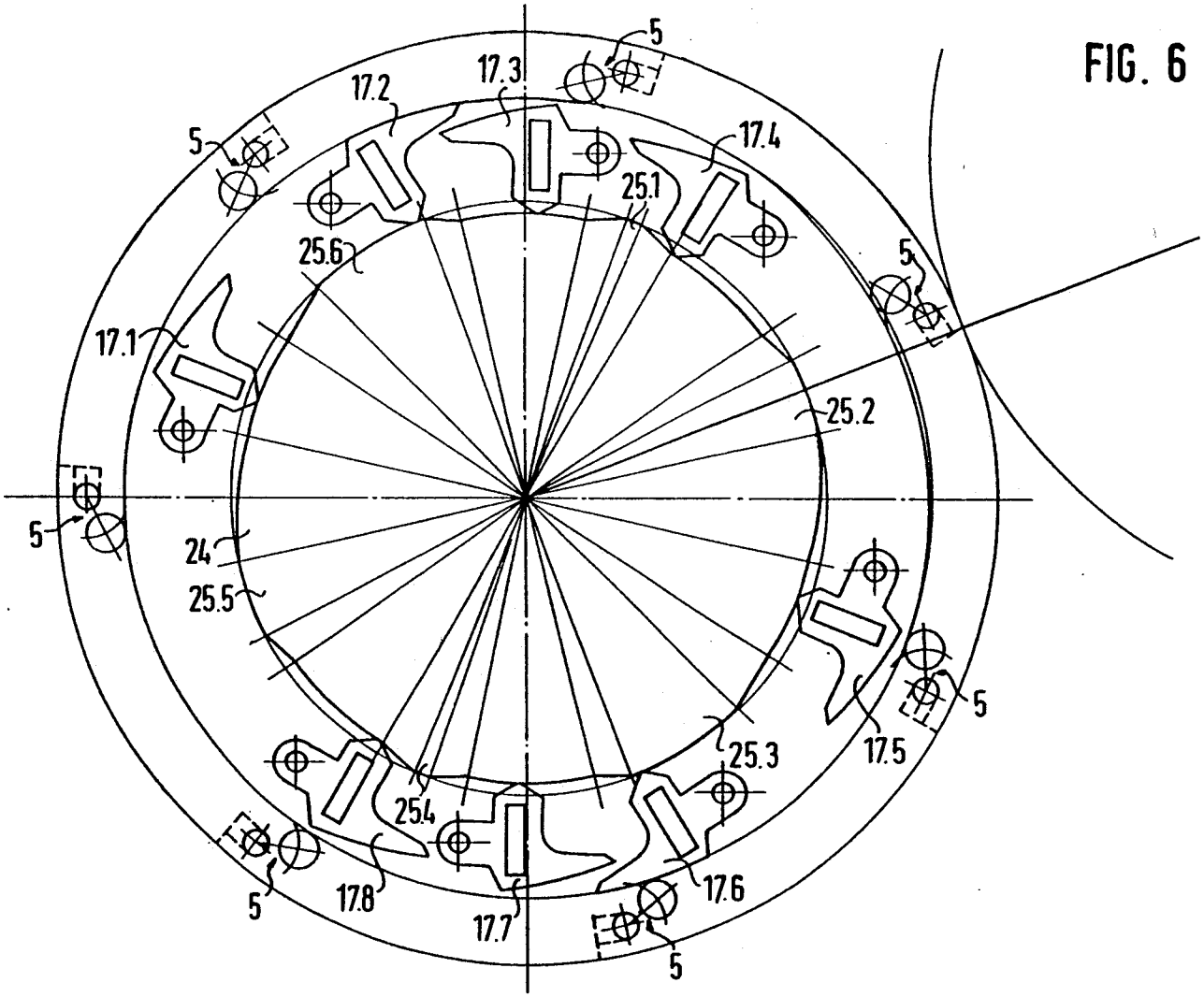

The setting of the setting disk 24, depicted in FIG. 6, is according to the production type partial-collect using 6e-form cylinder, which means six etchings (e.g. A, B, C, A, B, C) around its periphery. The result is a single-ply plus a two-ply product. The switching cam elements 17.2 and 17.6 are projected and switching cam elements 17.1, 17.3, 17.4, 17.5, 17.7, and 17.8 are retracted. The drive speed of the cam element carrier 22 and of the setting disk 24 is 7/6 of the speed of the collect cylinder 1. Every field of the collect cylinder 1 is controlled so that after one rotation, the tucking blade row 5 or gripper row 7 finds the follower roller of a free cam recess 16 and then has to rotate two time, before again finding an open cam recess 16.

Figure 7:
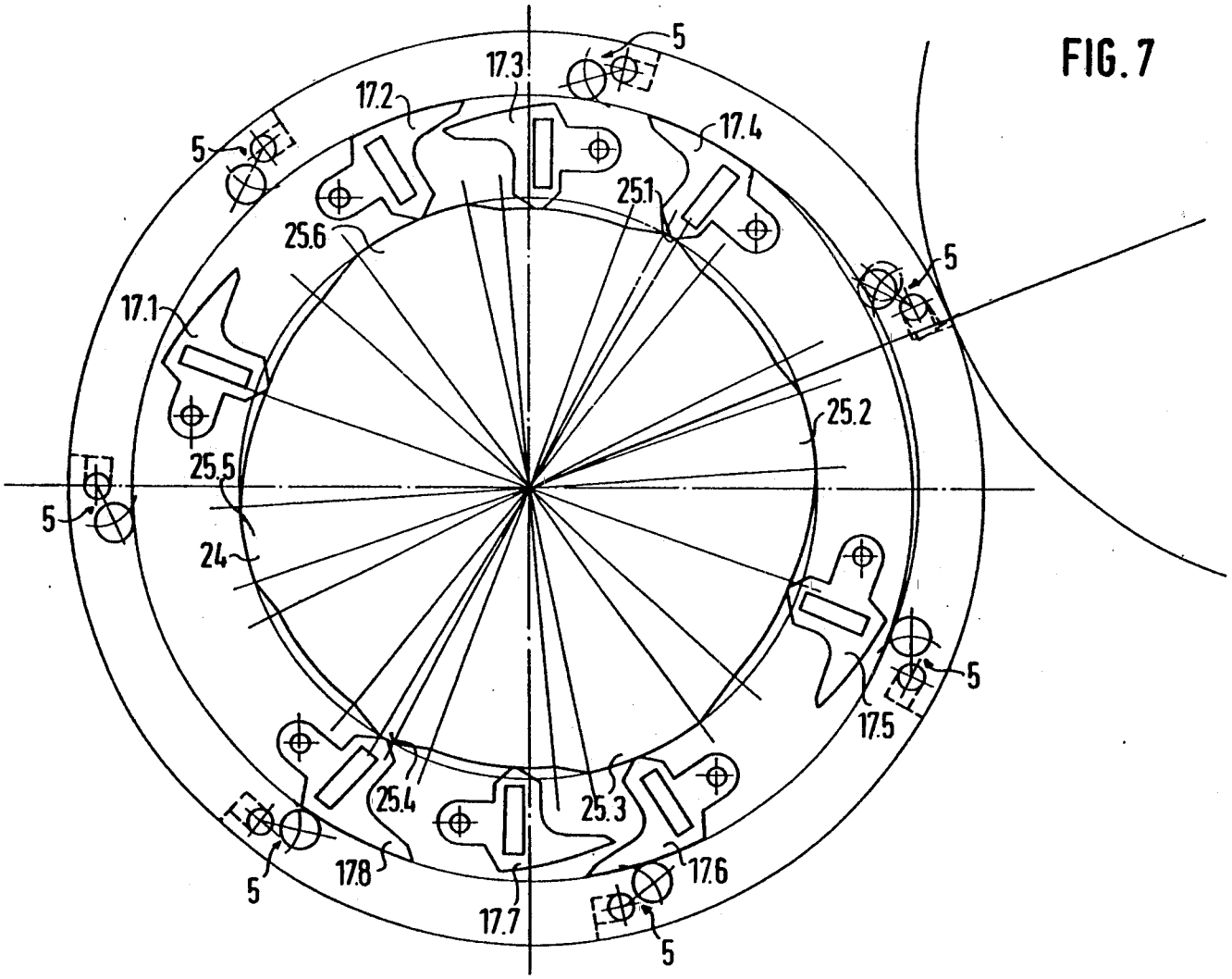
Figure 8:
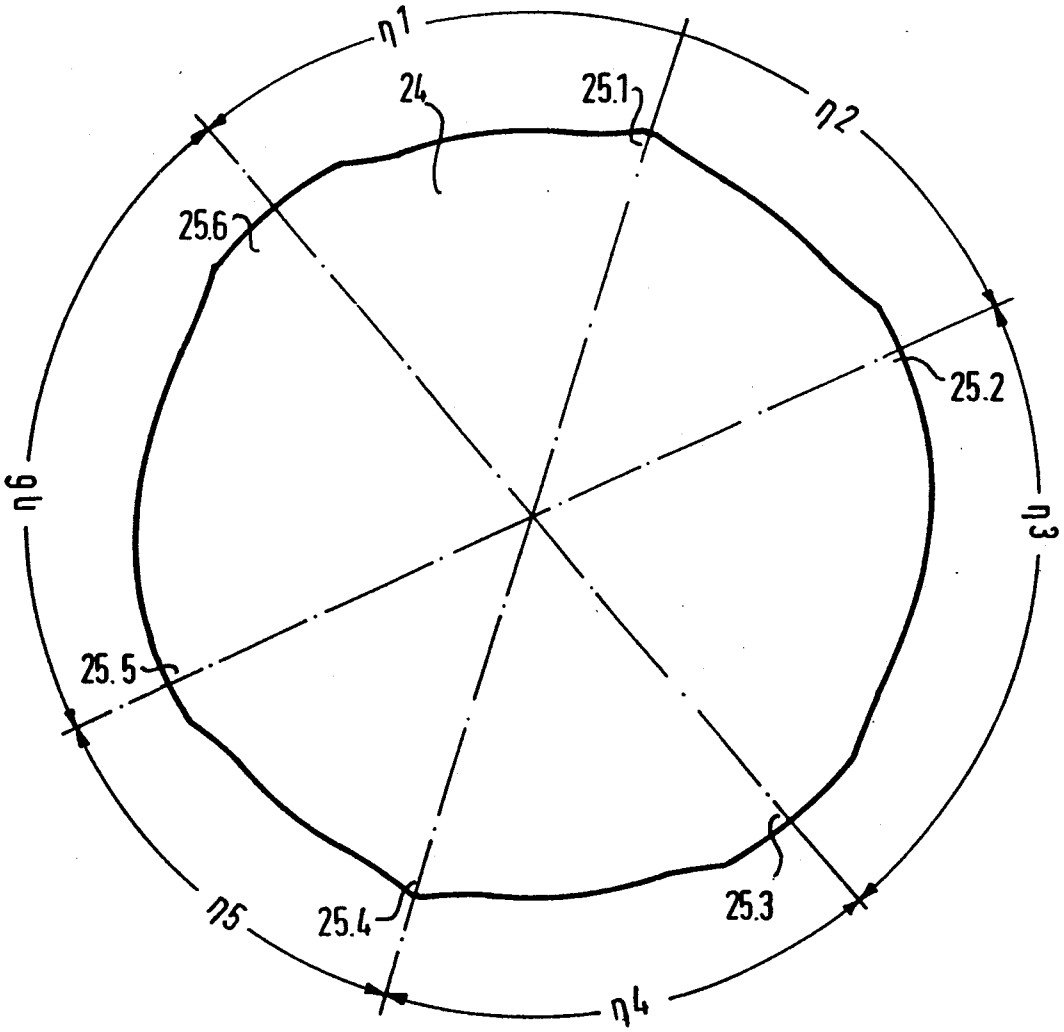
FIG. 8 is a side view of the setting disks of the collect cylinder and showing the cam elements and their angular spacing.

The placement of the setting disk 24, shown in FIG. 7 is according to the production type partial-collect using 8e-form cylinders, which means eight etchings (e.g. A, B, C, D, A, B, C, D). The result is a single-ply plus a three-ply product. The switching cam elements 17.2 and 17.4, 17.6 and 17.8 are projected and the switching cam elements 17.1 and 17.3 or 17.5 and 17.7 are retracted. The drive speed of the cam element carrier 22 and of the setting disk 24 is $\frac{7}{8}$ of the speed of the collect cylinder. Every field on the collect cylinder 1 is controlled so that after rotation, the tucking blade row 5 or gripper row 7 finds the follower roller of a cam recess 16 and then has to rotate three times, before finding again an open cam recess 16.

The structure and the workings of the covering device associated with the gripper actuation are the same as the actuation device for the tucking blade actuation system of FIG. 2 to 8 but with the difference that the grippers 7 holding the start of the sheet have already moved through the folding gap when the folding operation is performed. The activation of the tucking blades 5 and the opening of the grippers 7 takes place essentially simultaneously. These operations do however last a certain time and the opening of the grippers 7 takes place somewhat earlier, in case of the processing of short products, than is the case with the processing of longer ones, this being effected by the rotatability, as described above, of the cam 13, arranged on the gripper side, by means of the adjustment bar 20.

In the context of a so-called double width folder, on which two products placed side by side may be processed, the gripper bars 8 and the tucking blades 5 are subdivided along the length of the cylinder, each side of the cylinder having its own operating means. The structure of these two operating devices may be the same as the structure indicated in FIG. 1 for the operating device for the right hand cylinder half, but with the difference that the intermediate shaft 41 is not able to be coupled with the cylinder drive by means of an associated dog clutch, and it is connected via a bridging shaft 57 with the opposite intermediate shaft 41, as will also be seen from FIG. 1 The result is thus a common drive shaft extending over the full width of the cylinder.

In the above-described working example, the setting of the covering cam elements is performed by associated setting disks 24, something that makes possible an automatic presetting by suitable programming of the auxiliary drive device 48. However it would also be possible for the covering cam elements 17.1–17.8 to be individually set by hand in accordance with suitable instructions. In this case the cam element carrier 22 would simply be provided with suitable holding devices to hold the covering cam elements 17.1–17.8.

For setting the different production types there is adjusted respectively a setting disk 24 with the peripheral cams 25.1 to 25.6 in such a way that the covering cam elements 17.1 to 17.8 are brought in a position, in which the gripper rows and tucking blade rows are activated at the right time. For changing the different production types, the setting disk 24 must be rotated out from the zero position=position "production 4e-, 8e-non-collect" in relation to the covering cam element carrier 22 by an angle of $\lambda 1$ to $\lambda 5$, so that the covering cam elements 17.1–17.8 are brought in the desired position. For this purpose, the setting disk 24 must be rotated out from the zero position by $\lambda 1=0.5°$ in the counterclockwise direction, so that the covering cam elements 17.1–17.8 are brought into the production position "6e-non-collect".

The setting disk 24 has to be rotated by $\lambda 2=24°$ in the counterclockwise direction, so that the covering cam elements 17. to 17.8 are brought into the production position "4e- or 8e-double collect". The setting disk 24 has to be rotated by $\lambda 3=12°$ in the counterclockwise direction, so that the covering cam elements 17.1 to 17.8 are brought into the production position "6e-threefold-collect". The setting disk 24 has to be rotated by $\lambda 4=34°$ in the counterclockwise direction, so that the covering cam elements 17.1 to 17.8 are brought into the production position "6e-fourfold-collect" The setting disk 24 has to be rotated by $\lambda 5=12°$ in the counterclockwise direction, so that the covering cam elements 17.1 to 17.8 are brought into the production position "6e-partially-collect". The setting disk 24 has to be rotated by $\lambda 6=22°$ in the counterclockwise direction, so that the covering cam elements 17.1 to 17.8 are brought into the production position "6e-partially-collect".

Figure 9:
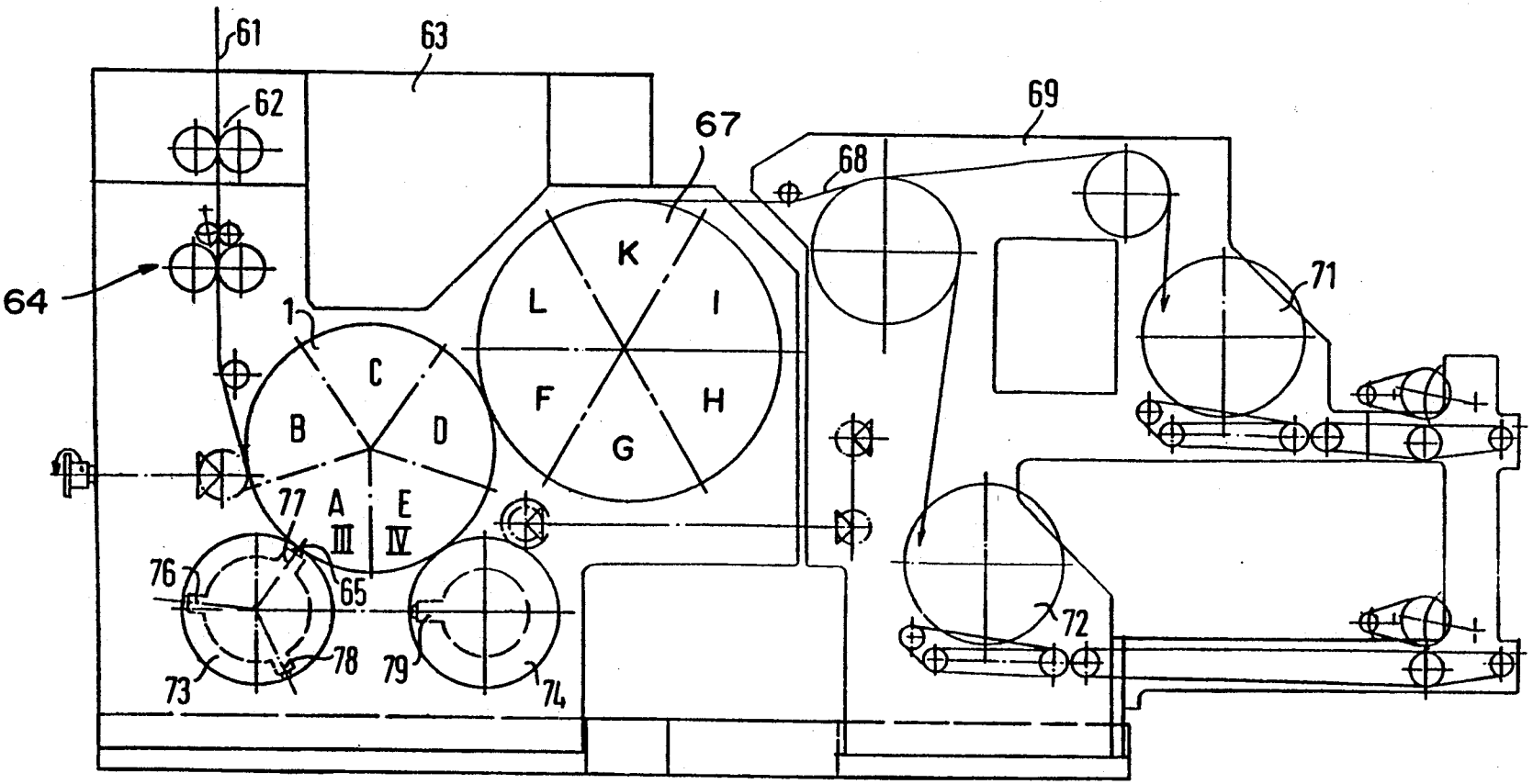
FIG. 9 is a side elevation view of a folder assembly with collect cylinder and cross-stitching devices in accordance with the present invention.

Turning now to FIG. 9, there may be seen a folding unit generally at 63 in accordance with the present invention. A ribbon 61, consisting of several superimposed paper webs, runs over a driven drag roller pair 62 into the folding unit 63. After having passed the drag roller pair 62, the ribbon 61 runs into a driven cutting cylinder group 64, running in synchronization with the plate cylinder of a printing unit. There, the ribbon 61 is cut crosswisely in a known way into subsequent signatures which are then led to a generally known tape guiding system, as shown in EP 00 66 867 A1. After being transported between upper and lower belts, the signatures come to the collect cylinder 1 and are gripped by means of controllable grippers or pins at their leading edge, so that they continue on the rotating collect cylinder 1. The collect cylinder 1 has an uneven number of fields, for example five fields, and is thus equipped with one cam controlled pin- or gripper and one tucking blade set, for each field.

A transfer- and jaw cylinder 67 cooperates with the collect cylinder 1. The transfer- and jaw cylinder 67 has one field more than the collect cylinder 1, thus six fields in the example. Each field is provided with a controllable, folding jaw, which cooperates with the tucking blades on the collect cylinder. The folded and stitched signatures are transported away from the transfer- and jaw cylinder 67 over a known transport tape system 68 to a delivery unit 69 with one or two deliveries 71, 72 such as fan deliveries.

A left cross stitching cylinder 73, and a right cross stitching cylinder 74 cooperate with the collect cylinder 1. The left cross stitching cylinder 73 is arranged in the area of quadrant III and the right cross stitching cylinder 74 in quadrant IV of the periphery of the collect cylinder 1 as seen in FIG. 9, and are in effective contact therewith. That means that the closing plates for the stitches are arranged on the collect cylinder 1 and cooperate with controllable counter dies of th cross stitching cylinders 73 and 74. The left cross stitching cylinder 73 has three or four controllable stitching devices 76, 77 and 78, with each such stitching device being offset by 120° or 90° with respect to each other. The right cross stitching cylinder 74 has a single controllable stitching device 79.

The collect cylinder 1 can perform the following productions:

1) Non-collect by using 4e-, 6e-, or 8e-form cylinders,
2) Double-collect by using 4e- or 8e-form cylinders,
3) Threefold-collect by using 6e-form cylinders,
4) Fourfold-collect by using 8e-form cylinders,
5) Partial-collect (Non-collected signatures plus double-collected signatures) by using 6e-form cylinders,
6) Partial-collect (Non-collected signatures plus threefold-collected signatures) by using 8e-form cylinders, The left or first cross stitching cylinder 73, which could alternatively be arranged at the right is rotatable in the same direction and rotates with the same peripheral speed as the collect cylinder 1. That allows one of the three or even four stitching devices 76, 77, 78 to move with one of the five fields A, B, C, D, E or seven fields A–G of the collect cylinder 1 into a possible working position, such as field A with 77; B with 76; C with 78; D with 77; E with 76 or the like.

The left cross stitching cylinder 73 is controllable as follows:

Position 1 Cross stitching cylinder 73 and stitching devices 76, 77, 78 being at standstill, which means, no stitching Position 2 The stitching devices 76, 77, 78 cooperate continuously with the fields A, B, C, D, E etc. Each of the fields A to E receives at every passing by the stitching device 76 or 77 or 78, a stitching in stitching position 65, right stitching cylinder 74 being at standstill, that means, each signature is stitched.

Position 3 Each of the fields A to E receives at every second passing through the stitching position 65 a stitching from the stitching device 76 or 77 or 78, right stitching cylinder 74 being at standstill, that means, every second signature is stitched.

Position 4 Each of the fields A to E receives at every third passing through the stitching position 65 a stitching from the stitching device 76 or 77 or 78, right stitching cylinder 74 being at standstill, that means, every third signature is stitched.

Position 5 Each of the fields A to E receives at every fourth passing through the stitching position 65 a stitching from the stitching device 76 or 77 or 78, right stitching cylinder 74 being at standstill, that means, every fourth signature is stitched.

Position 6 (=Partial-collect at 6e; (AB+C)) collect cylinder 1 is switched in production kind double-collect, plus non-collect, printing unit with 6e-form cylinder, left cross stitching cylinder 73 and right cross stitching cylinder 74 in operation; the left cross stitching cylinder 73 stitches by means of an activated stitching device 76 or 77 or 78 every third field e.g. A, D, B, E, C etc. after having two times passed through its stitching position 65 (=double-collect; AB) the right side cross stitching cylinder 74, with e.g. one single stitching device 79 stitches also every third field, beginning with the next field B after field A, in e.g. following sequence B, E, C, A, D, B etc.; every third field beginning with the next field C after A in following sequence C, A, D, B, E, C etc. remain unstitched. In this field, there is no signature. That means, the partial-collected signatures are stitched.

The signatures stitched in position 6, are given to the transfer-and jaw cylinder 67 and cross folded and then given in a known way to the conveyor belt system 68. A generally known, but not specifically shown signature shunt leads the products, such as double-collected products (AB) to the upper delivery 71 and the non-collected products (C) to the lower delivery 72 of the folding unit.

Position 7 (=Partial-collect at 8e; (ABC+D) collect cylinder 1 switched in production type threefold-collect, printing unit with 8e-form cylinder, left cross stitching cylinder 73 and right cross stitching cylinder 74 in operation; the left cross stitching cylinder 73 stitches by means of alternately stitching by the stitching devices 76, 77 and 78 every fourth field e.g. A, E, D, C, B etc. after having three times passed through its stitching position 65 (=threefold-collect; ABC) the right cross stitching cylinder 74, with e.g. one single stitching device 79 stitches as well every fourth field, beginning with the next field B after field A, in e.g. following sequence B, A, E, D, C, B etc.; every third and fourth field beginning with the next field C or D after field A, in following sequence C-D, B-C. A-B, E-A, D-E, etc. remain unstitched.

The signatures stitched in position 7, are given to the transfer- and jaw cylinder 67 and cross folded and then given in a known way to the conveyor belt system 68. A generally known signature shunt leads the threefold-collected products (ABC) to the upper delivery 71 and the non-collected products (D) to the lower delivery 72 of the folding unit.

With the above-described folder assembly it is possible to stitch, in spite of the production of signatures (double- and non-collected) having a different thickness, out of a ribbon 61 and on one single collect cylinder 1 and a transfer- and jaw cylinder 67 and to have at the same time a continuous wire transport. In addition, every stitching apparatus 73, 74 can be adjusted in an advantageous way exactly on the different thickness of the signatures.

While a preferred embodiment of a folder assembly in accordance with the present invention has been set forth fully and completely hereinabove, it will be apparent to one of skill in the art that a number of changes in, for example the type of printing press used, the sizes of the cylinders, the types of sheet grippers and folding blades and the like may be made without departing from the true spirit and scope of the invention which is accordingly to be limited only by the following claims.

What is claimed is:

1. A folder assembly usable in cooperation with a printing unit having a forme cylinder provided with a plurality of printing plates on its periphery; said folder assembly comprising:

a collect cylinder, said collect cylinder having an uneven number of peripheral fields with there being more than three such peripheral collect cylinder fields;

a transfer and jaw cylinder positioned after, in the direction of paper travel, said collect cylinder;

a split delivery positioned after in the direction of paper travel, said transfer and jaw cylinder and receiving paper products from said transfer and jaw cylinder; and first and second separate stitching cylinders, said first and second stitching cylinders cooperating with said collect cylinder and being positioned before, in the direction of paper travel, said transfer and jaw cylinder, one of said first and second stitching cylinders having at least three stitching devices evenly arranged at equal peripheral angles on a peripheral surface of said one of said first and second stitching cylinders and an other of said first and second stitching cylinders having at least one stitching device on a peripheral surface of said other of said first and second stitching devices.

2. The folder assembly of claim 1 wherein said collect cylinder has five peripheral fields.

3. The folder assembly of claim 1 wherein said transfer and jaw cylinder has an even number of peripheral fields with there being at least one more of said transfer and jaw cylinder peripheral fields than said collect cylinder peripheral fields.

4. The folder assembly of claim 1 wherein said first stitching cylinder has three stitching devices and said second stitching cylinder has one stitching device.

* * * * *